US012631188B2

(12) United States Patent
Hsieh et al.

(10) Patent No.: US 12,631,188 B2
(45) Date of Patent: May 19, 2026

(54) AXIAL-FLOW HEAT-DISSIPATION FAN

(71) Applicant: Acer Incorporated, New Taipei City (TW)

(72) Inventors: Cheng-Wen Hsieh, New Taipei City (TW); Mao-Neng Liao, New Taipei City (TW); Kuang-Hua Lin, New Taipei City (TW); Wei-Chin Chen, New Taipei City (TW); Tsung-Ting Chen, New Taipei City (TW)

(73) Assignee: Acer Incorporated, New Taipei City (TW)

( * ) Notice: Subject to any disclaimer, the term of this patent is extended or adjusted under 35 U.S.C. 154(b) by 0 days.

(21) Appl. No.: 18/765,348

(22) Filed: Jul. 8, 2024

(65) Prior Publication Data

US 2025/0027502 A1 Jan. 23, 2025

(30) Foreign Application Priority Data

Jul. 19, 2023 (TW) ..... 112126885

(51) Int. Cl.

| | |
|---|---|
| ***F04D 19/00*** | (2006.01) |
| ***F04D 29/38*** | (2006.01) |
| ***F04D 29/66*** | (2006.01) |
| *F04D 25/06* | (2006.01) |

(52) U.S. Cl.

CPC ..... *F04D 19/002* (2013.01); *F04D 29/388* (2013.01); *F04D 29/667* (2013.01); *F04D 25/0613* (2013.01)

(58) Field of Classification Search

CPC .... F04D 29/667; F04D 29/388; F04D 29/384; F04D 19/002; F01D 5/145

See application file for complete search history.

(56) References Cited

U.S. PATENT DOCUMENTS

| | | | | | |
|---|---|---|---|---|---|
| 1,352,848 | A | * | 9/1920 | Stanyo | F04D 29/384 416/236 R |
| 1,864,803 | A | * | 6/1932 | Clark | B63H 1/26 159/4.2 |
| D110,876 | S | * | 8/1938 | Preston | |
| 2,238,749 | A | * | 4/1941 | Peltier | F04D 29/384 416/212 R |
| D131,271 | S | * | 2/1942 | Collura | 416/228 |
| D191,401 | S | * | 9/1961 | Gesmar | |
| 4,128,363 | A | * | 12/1978 | Fujikake | F04D 19/002 416/175 |
| 4,172,691 | A | * | 10/1979 | Comstock | F04D 29/388 416/242 |

(Continued)

FOREIGN PATENT DOCUMENTS

| | | |
|---|---|---|
| CN | 202789712 | 3/2013 |
| TW | I305810 | 2/2009 |

*Primary Examiner* — Courtney D Heinle
*Assistant Examiner* — Behnoush Haghighian
(74) *Attorney, Agent, or Firm* — JCIPRNET

(57) ABSTRACT

An axial-flow heat dissipation fan including a frame, a hub, and a plurality of blades is provided. The frame has an air inlet and an air outlet. The hub is rotatably arranged in the frame. The blades disposed at side of the hub respectively and rotate along with the hub. Each of the blades has a front surface facing toward the air inlet and a rear surface facing toward the air outlet. A surface roughness of the front surface is different from a surface roughness of the rear surface.

5 Claims, 7 Drawing Sheets

(56) References Cited

U.S. PATENT DOCUMENTS 4,174,924 A * 11/1979 Smithson, Jr. ..... F04D 29/388 416/242
4,720,239 A * 1/1988 Owczarek ..... F01D 5/141 415/181
4,846,629 A * 7/1989 Takigawa ..... B64C 11/16 416/223 R
4,859,150 A * 8/1989 Takigawa ..... F04D 29/681 416/223 R
4,869,644 A * 9/1989 Takigawa ..... F04D 29/661 416/223 R
4,907,765 A * 3/1990 Hirschel ..... B64C 21/10 244/130
4,969,799 A * 11/1990 Usui ..... F04D 29/368 415/12
5,193,983 A * 3/1993 Shyu ..... F04D 29/384 416/236 R
5,244,349 A * 9/1993 Wang ..... F04D 29/388 415/119
6,004,102 A * 12/1999 Kuefner ..... F01D 5/286 416/224
6,183,197 B1 * 2/2001 Bunker ..... F01D 5/141 416/235
6,213,711 B1 * 4/2001 Muller ..... F01D 5/145 415/220
6,296,446 B1 * 10/2001 Ishijima ..... F04D 29/681 416/DIG. 2
6,354,804 B1 * 3/2002 Leung ..... B63H 1/18 416/231 R
6,538,887 B2 * 3/2003 Belady ..... F04D 29/38 415/200
6,872,048 B2 * 3/2005 Uselton ..... F24F 1/40 416/235
7,207,772 B2 * 4/2007 Johann ..... F01D 5/16 415/181
7,334,997 B2 * 2/2008 Karafillis ..... F01D 5/34 416/224
7,351,041 B2 * 4/2008 Uselton ..... F24F 1/40 415/119
7,494,325 B2 * 2/2009 Gustafson ..... F04D 29/681 415/914
7,878,759 B2 * 2/2011 Mills ..... F04D 29/668 416/61
8,033,789 B2 * 10/2011 Read ..... F01D 5/26 416/241 A
8,083,487 B2 * 12/2011 Wood ..... F04D 29/324 416/223 R
8,092,185 B2 * 1/2012 Hwang ..... F04D 29/667 415/203
8,118,555 B2 * 2/2012 Guemmer ..... F01D 5/145 416/223 R
8,419,372 B2 * 4/2013 Wood ..... F04D 29/324 416/223 R
8,460,779 B2 * 6/2013 Gupta ..... F15D 1/004 428/167
8,512,004 B2 * 8/2013 Nakagawa ..... F04D 29/384 415/173.1
8,746,053 B2 * 6/2014 Brake ..... F03D 1/0608 73/147
9,109,452 B2 * 8/2015 Martin ..... F01D 5/186
9,562,536 B2 * 2/2017 Jiang ..... F04D 29/544
9,981,756 B2 * 5/2018 Schwie ..... G01K 13/028
10,107,302 B2 * 10/2018 Berschback ..... F01D 5/141
10,450,867 B2 * 10/2019 Bunker ..... F01D 5/141
10,465,525 B2 * 11/2019 Jones ..... B29C 64/153
10,539,149 B2 * 1/2020 Chang ..... F04D 29/667
10,539,157 B2 * 1/2020 Schilling ..... F04D 29/681
10,662,975 B2 * 5/2020 Cahill ..... F04D 29/38
10,954,958 B2 * 3/2021 Yu ..... F04D 29/667
11,193,377 B2 * 12/2021 Shabbir ..... F01D 5/12
11,492,923 B2 * 11/2022 Oliveira ..... B64D 15/16
11,639,665 B2 * 5/2023 Zaccardi ..... F01D 9/065 416/96 R
11,828,476 B2 * 11/2023 Park ..... F24F 1/38
11,970,979 B2 * 4/2024 Johnson ..... F02C 7/24
2005/0147498 A1 * 7/2005 Chien ..... F04D 29/30 416/236 R
2005/0163621 A1 * 7/2005 Mills ..... F01D 5/145 416/235
2005/0214113 A1 * 9/2005 Johann ..... F04D 29/668 415/181
2006/0034697 A1 * 2/2006 Chen ..... F04D 29/384 416/231 R
2008/0219852 A1 * 9/2008 Guemmer ..... F01D 5/145 416/235
2011/0164981 A1 * 7/2011 Hardwicke ..... F04D 29/388 427/256
2011/0262705 A1 * 10/2011 Gupta ..... B64C 21/10 428/156
2013/0236322 A1 * 9/2013 Schmidt ..... F01D 5/288 428/156
2014/0003933 A1 * 1/2014 Inada ..... F04D 29/681 415/220
2017/0167510 A1 * 6/2017 Berschback ..... F01D 9/04
2017/0234134 A1 * 8/2017 Bunker ..... F04D 29/542 415/208.2
2018/0030996 A1 * 2/2018 Schilling ..... F04D 29/38
2018/0283180 A1 * 10/2018 Jain ..... F04D 29/544
2018/0283403 A1 * 10/2018 Schilling ..... F01P 5/02
2019/0101002 A1 * 4/2019 Duffin ..... F01D 5/145
2021/0156258 A1 * 5/2021 Shabbir ..... F01D 5/284
2022/0178558 A1 * 6/2022 Park ..... F24F 1/38

* cited by examiner

100

AXIAL-FLOW HEAT-DISSIPATION FAN

CROSS-REFERENCE TO RELATED APPLICATION

This application claims the priority benefit of Taiwan application serial no. 112126885, filed on Jul. 19, 2023. The entirety of the above-mentioned patent application is hereby incorporated by reference herein and made a part of this specification.

BACKGROUND

Technical Field

The invention relates to a heat-dissipation fan, and in particular, to an axial-flow heat-dissipation fan.

Description of Related Art

The axial-flow fan has a simple structure and has the characteristics of large air volume and low static pressure, so it is widely used in cooling fans or ventilation fans for personal computers and servers. In order to improve the air supply characteristics of the axial-flow fan to reduce noise and other optimization purposes, the number and structure of the blades are often adjusted, or various designs and tests are carried out on the structure of the air flow.

For example, when the axial-flow fan is used for heat dissipation, its obvious disadvantage is that the pressure of the flow field is too small. Therefore, how to improve this disadvantage is really a problem that relevant technical personnel need to solve.

SUMMARY

The present invention provides an axial-flow heat-dissipation fan, which adjusts the pressure, direction and concentration of the airflow generated by the blades by adjusting the surface roughness of the front surface and the rare surface of each of the blades.

The axial-flow heat dissipation fan of the present invention includes a frame, a hub, and a plurality of blades. The frame has an air inlet and an air outlet. The hub is rotatably arranged in the frame. The blades disposed at side of the hub respectively and rotate along with the hub. Each of the blades has a front surface facing toward the air inlet and a rear surface facing toward the air outlet. A surface roughness of the front surface is different from a surface roughness of the rear surface.

Based on the above, the axial-flow heat-dissipation fan adjusts the surface roughness of the upper blade surface (the front surface) and the lower blade surface (the rear surface) of the blades, and then reaches the effect of adjusting the pressure on the blade surface. Among them, the pressure difference or flow velocity difference between the front surface and the rear surface of the blades can be adjusted according to the premise of not changing the shape of the blades, so as to meet the demand or adjust according to the current situation of the flow field. Furthermore, the designer can also adjust the roughness of the rear surface of the blades according to the distribution of the airflow on the surface of the blades, and according to the direction and concentration of the required airflow, so as to meet the heat dissipation requirements.

DESCRIPTION OF THE EMBODIMENTS

Figure 1:
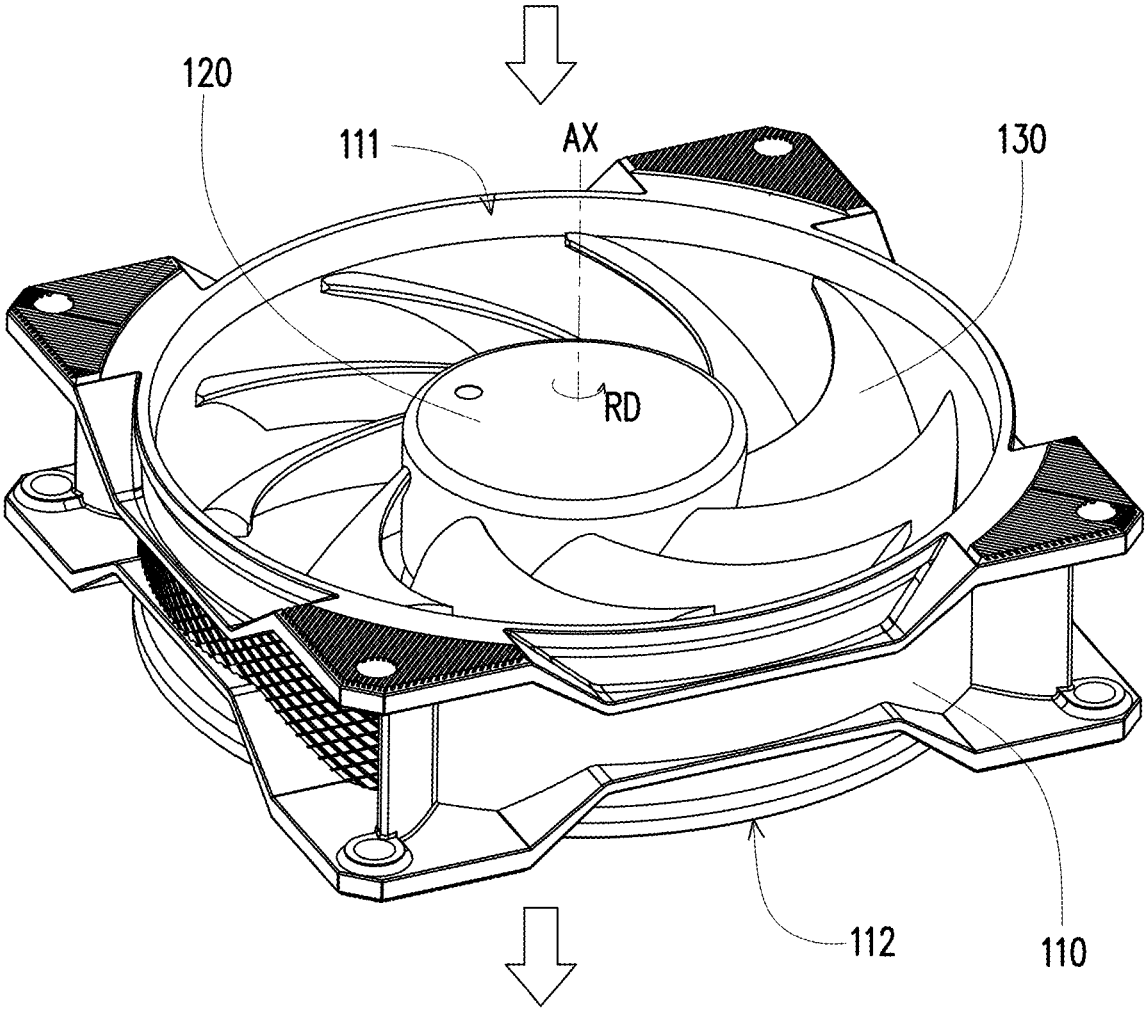
FIG. 1 is a schematic diagram of the axial-flow heat-dissipation fan according to an embodiment of the present invention.
Figure 2:
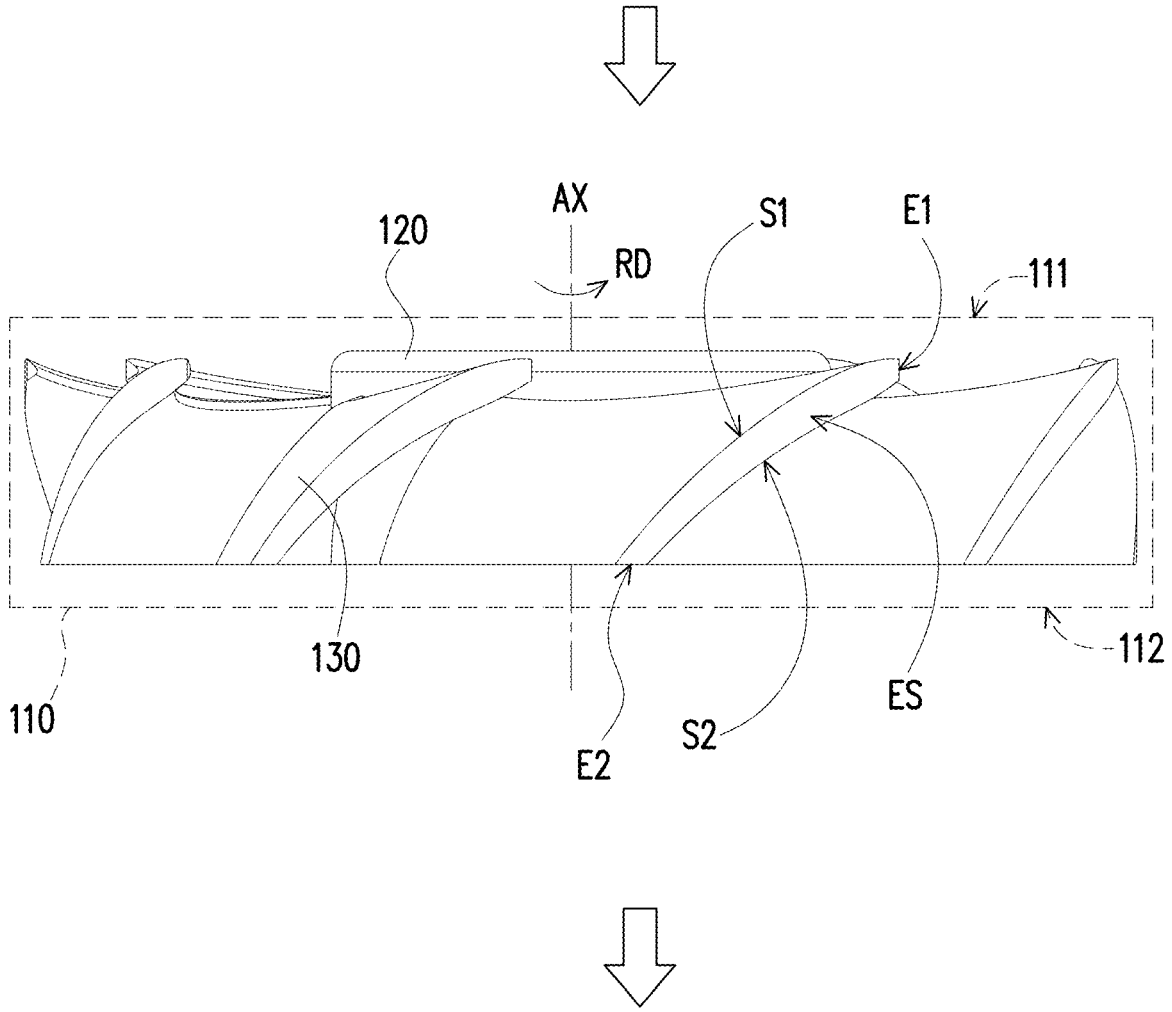
FIG. 2 is a simple side view of the axial-flow heat-dissipation fan of FIG. 1.
Figure 3:
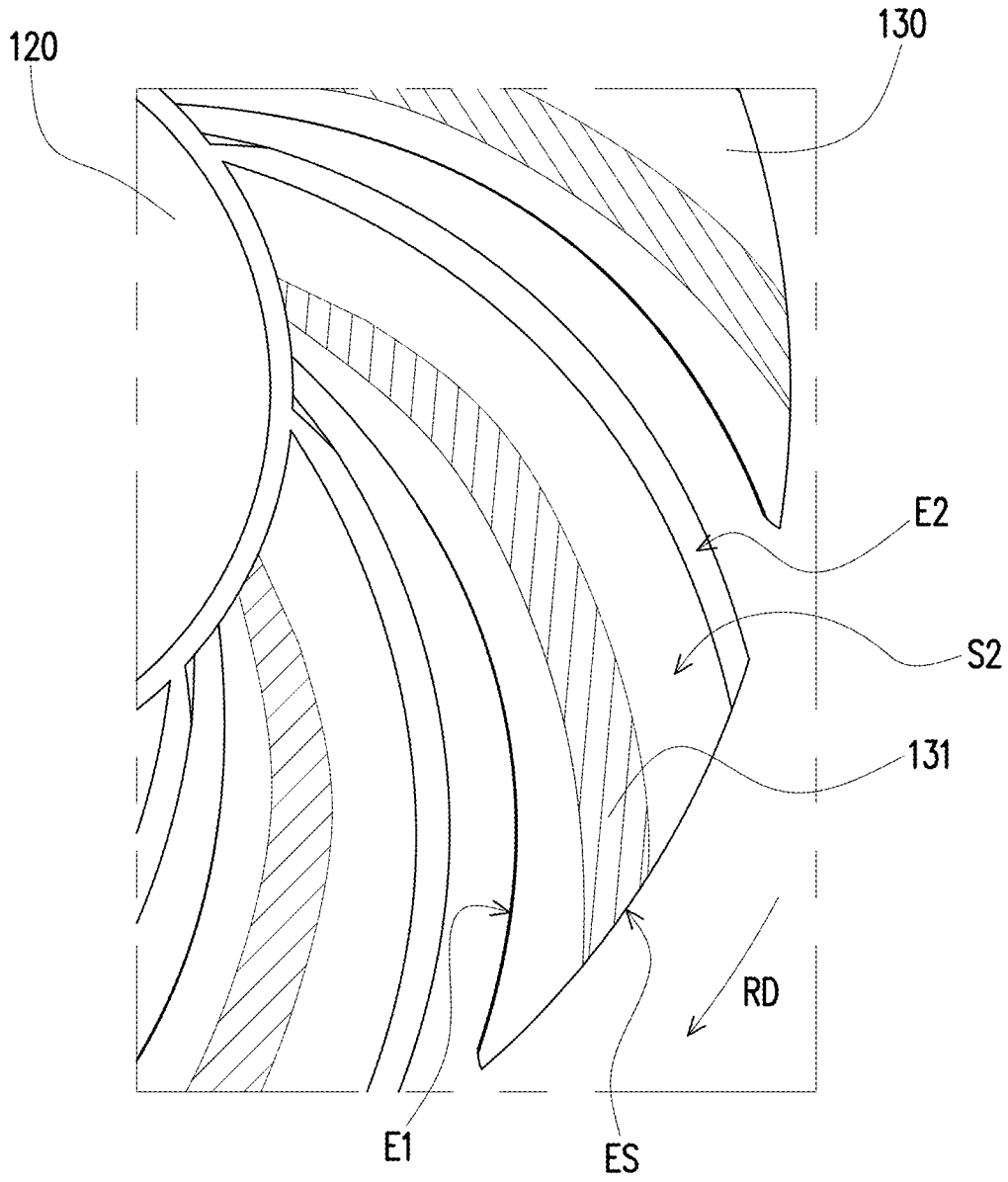
FIG. 3 is a partial bottom view of the axial-flow heat-dissipation fan in FIG. 1.

FIG. 1 is a schematic diagram of an axial-flow heat-dissipation fan according to an embodiment of the present invention. FIG. 2 is a simple side view of the axial-flow heat-dissipation fan of FIG. 1. FIG. 3 is a partial bottom view of the axial-flow heat-dissipation fan in FIG. 1. Referring to FIG. 1 to FIG. 3 at the same time, in the embodiment, the axial-flow heat-dissipation fan 100 is suitable for electronic devices, such as system fans or CPU cooling fans installed in a desktop computer, and includes a frame 110, a hub 120 and a plurality of blades 130. The frame 110 has an air inlet 111 and an air outlet 112. The plurality of blades 130 are disposed at side of the hub 120 respectively, and the hub 120 is rotatably disposed in the frame 110 and located between the air inlet 111 and the air outlet 11. Then, through the connection with the motor, the hub 120 is driven to rotate along the direction RD with the axis AX as a reference, and at the same time, the blades 130 are driven to rotate along the direction RD with the hub 120 to generate airflow entering the frame 110 from the air inlet 111 and leaving the frame 110 from the air outlet 112.

In details, as shown in FIG. 2 and FIG. 3, each of the blades 130 has a front surface S1 and a rear surface S2 facing each other. The front surface S1 faces toward the air inlet 111, the rear surface S2 faces toward the air outlet 112. Furthermore, each of the blades 130 also has a leading edge E1 and a trailing edge E2, which are respectively adjacent to the front surface S1 and the rear surface S2. When the blades 130 is rotated with the hub 120, the leading edge E1 is located on a windward side and the trailing edge E2 is located on a leeward side.

Figure 4:
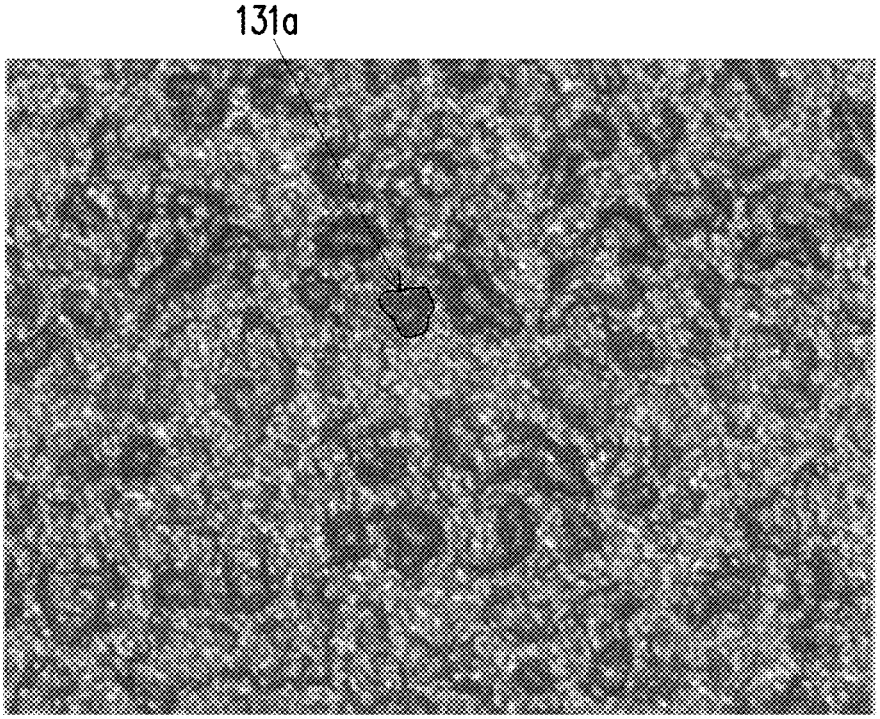
FIG. 4 is a schematic structural view of the rough area of FIG. 3.

FIG. 4 is a schematic structural view of the rough area of FIG. 3, which is a gold photomicrograph of the rough area 131. Referring to FIG. 3 and FIG. 4 at the same time, more importantly, the blades 130 of the embodiment also has the rough area 131 located on the rear surface S2 and occupying part of the rear surface S2, whose range extends radially with the blades 130 to extend from the hub 120 to an end edge ES of the blades 130. Herein, the end edge ES can be regarded as the farthest side edge of the rear surface S2 relative to the hub 120. In other words, as shown in FIG. 3, for the blades 130, except for the hub 120, the leading edge E1, the end edge ES and the trailing edge E2 are adjacent in sequence. In the embodiment, the rough area 131 has etched microstructures, and has a plurality of etching particles 131*a*. And the roughness of the rough area 131 is defined by the etching depth of the etched microstructures of 10 μm to 45 μm and the etching particles 131*a* of 15 to 150 per centimeter. The above-mentioned etching is for the mold forming the blades 130, and the corresponding pattern (the rough area 131) can be successfully formed on the blades 130 after forming the etching pattern on the mold.

Figure 5:
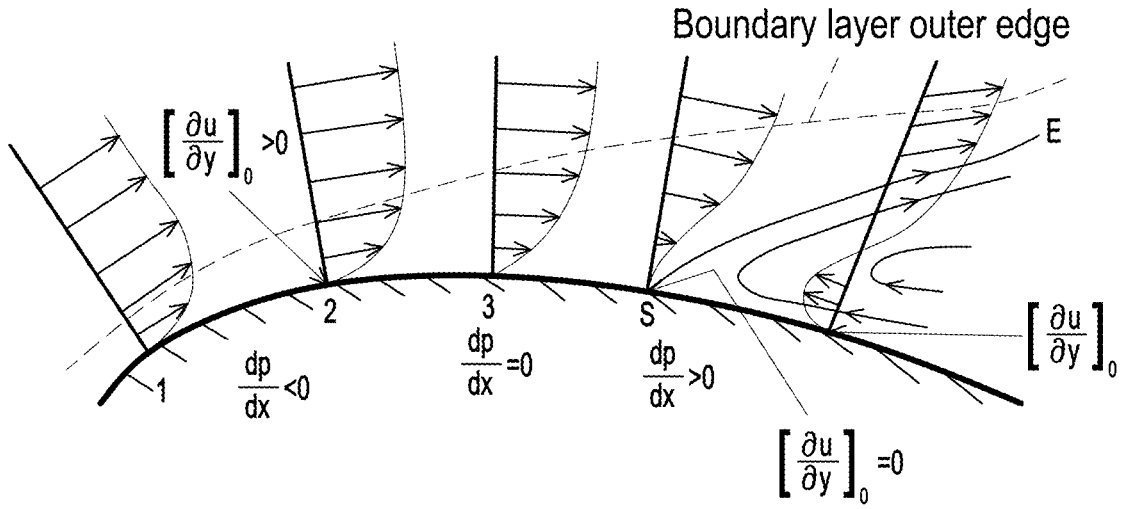
FIG. 5 is a simplified schematic diagram of a fluid boundary layer.

FIG. 5 is a simplified schematic diagram of a fluid boundary layer. Referring to FIG. 5, the formation principle of vortex is briefly described below. Generally speaking, the boundary layer formed by the fluid and the surface of the object will be affected by the roughness of the surface of the object. As shown on the right side of FIG. 5, when the fluid pressure increases, the fluid at an inner edge of the boundary layer will gradually generate a reverse flow field E due to the viscous resistance on the surface of the object, thereby causing the separation of the fluid from the surface of the object. And this phenomenon of fluid separation is the main cause of vortex.

Here, boundary layer equation group:

$$u\frac{\partial u}{\partial x}+v\frac{\partial u}{\partial y}\approx U\frac{dU}{dx}+\frac{\mu}{\rho}\frac{\partial^2 u}{\partial y^2},$$

when the boundary condition y=0, then u=v=0, and when y=∞, then u=U(x). Where u, v represent the velocity components of the fluid in the x, y direction, U(x) represents the flow velocity, μ represents the dynamic viscosity (dynamic viscosity coefficient), ρ represents the fluid density, the direction along the wall of the object is the x-axis, and the direction perpendicular to the wall is the y-axis.

Based on the separation phenomenon of the boundary layer shown in FIG. 5, the rough area 131 shown in FIG. 3 in the embodiment can provide a basis for the designer to adjust the air flow.

Referring to FIG. 2 and FIG. 3 again, in the embodiment, in order to improve the airflow pressure difference between the front surface S1 and the rear surface S2, the surface roughness of the front surface S1 in the embodiment is different from the surface roughness of the rear surface S2. And especially make the surface roughness of the rear surface S2 larger than the surface roughness of the front surface S1. Therefore, in the embodiment, the rough area 131 needs to be formed on the rear surface S2, while the front surface S1 is kept smooth to achieve the effect of increasing the air outlet pressure of the axial-flow heat-dissipation fan 100. Certainly, in another unillustrated embodiment, the rough area 131 mentioned above can also be set on the front surface S1 and the rear surface S2. However, if the premise of increasing the air outlet pressure is still desired, the surface roughness of the rear surface S2 must still be greater than that of the front surface S1.

Figure 6:
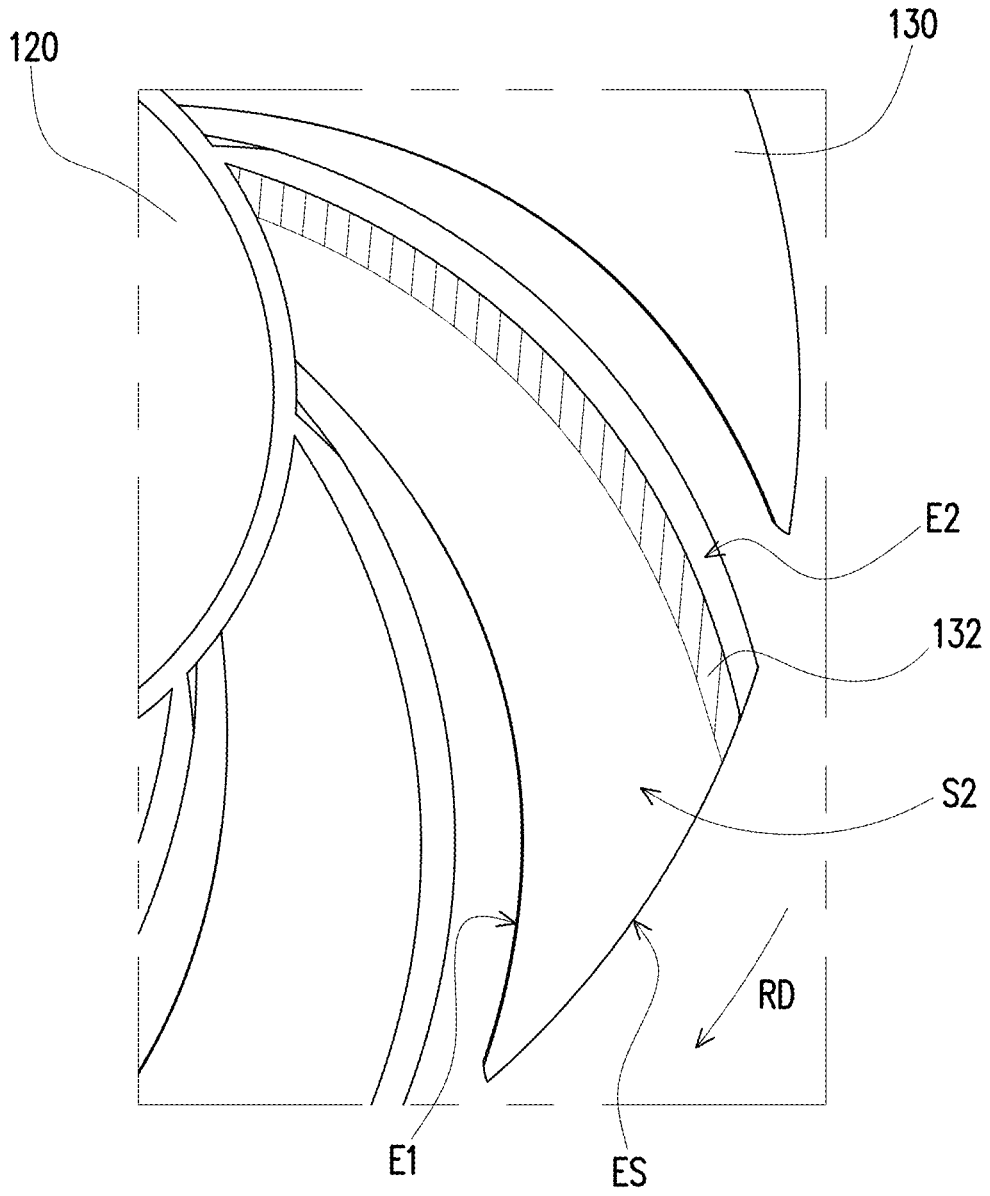
FIG. 6 is a partial bottom view of the axial-flow heat-dissipation fan of another embodiment of the present invention.

FIG. 6 is a partial bottom view of the axial-flow heat-dissipation fan of another embodiment of the present invention. Referring to FIG. 6, different from the foregoing, the axial-flow heat-dissipation fan of the embodiment is intended to reduce noise. Therefore, a rough area 132 is formed on the rear surface S2, and the rough area 132 extends from the hub 120 along the trailing edge E2 to the end edge ES. For the blades 130, the airflow has been separated from the rear surface S2 when it reaches the trailing edge E2, but due to the difference in airflow pressure, turbulent flow will be generated on the rear surface S2, resulting in obvious aerodynamic noise. Accordingly, in the embodiment, through the arrangement of the through area 132, the degree of confusion of the turbulent flow is further increased, and the turbulent flow is further canceled out to achieve the effect of reducing noise.

Figure 7:
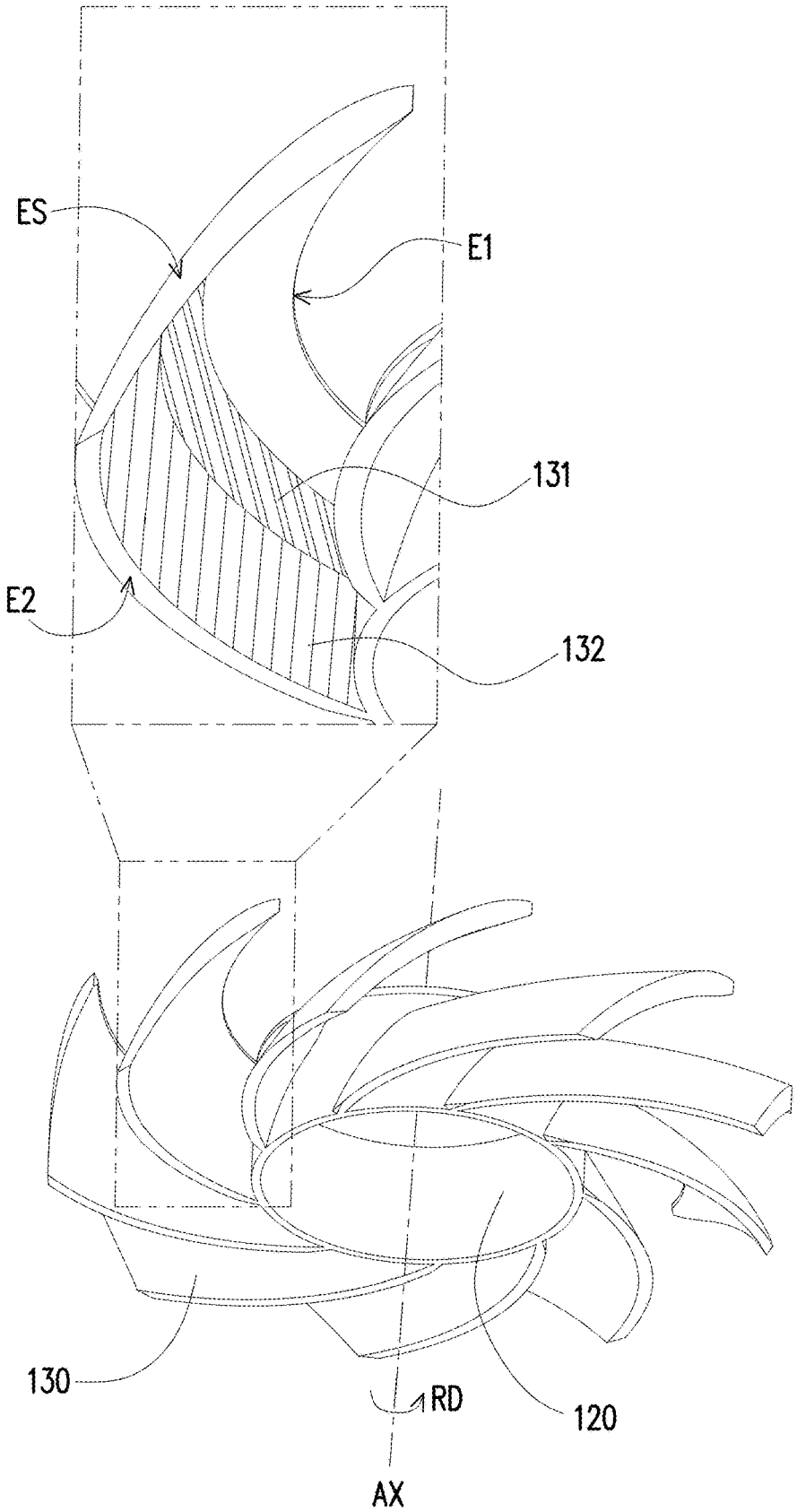
FIG. 7 is a schematic diagram of the axial-flow heat-dissipation fan of another embodiment of the present invention.

FIG. 7 is a schematic diagram of the axial-flow heat-dissipation fan of another embodiment of the present invention. Referring to FIG. 7, the blades 130 of the embodiment combines the features of the embodiments of FIG. 3 and FIG. 6 described above. That is to say, in the case that the rough area 132 can effectively reduce the turbulence effect, the combination of the rough area 131 can increase the air outlet pressure effect. That is, the rough area 131, 132 is adjacent to each other on the rear surface S2 of the blades 130. Among them, the roughness of the rough area 132 must be greater than or equal to the roughness of the rough area 131 in order to control the fluid separation point or provide a better control flow field.

According to above-mentioned, the present invention also provides the design/manufacturing method about the axial-flow heat-dissipation fan according to above-mentioned embodiment. That is to say, in the design stage, the blade shape of the blades in the initial design is analyzed to check the separation state of the airflow and the blades, and then the design roughness area at a specific place of the blades is increased, so as to control (adjust) the direction and concentration of the outlet airflow. Furthermore, as shown in the aforementioned embodiments of FIG. 3, FIG. 6 or FIG. 7, the position and range of the rough area on the surface of the blades 130 are adjusted according to the specific requirements of the axial-flow heat-dissipation fan.

In summary, in the above-mentioned embodiment of the present invention, the axial-flow heat-dissipation fan adjusts the surface roughness of the upper blade surface (the front surface) and the lower blade surface (the rear surface) of the blades, and then reaches the effect of adjusting the pressure on the blade surface. Among them, the pressure difference or flow velocity difference between the front surface and the rear surface of the blades can be adjusted according to the premise of not changing the shape of the blades, so as to meet the demand or adjust according to the current situation of the flow field. Furthermore, the designer can also adjust the roughness of the rear surface of the blades according to the distribution of the airflow on the surface of the blades, and according to the direction and concentration of the required airflow, so as to meet the heat dissipation requirements.

What is claimed is:

1. An axial-flow heat dissipation fan, comprising:

a frame, having an air inlet and an air outlet;

a hub, rotatably arranged in the frame; and a plurality of blades, disposed at side of the hub respectively and rotate along with the hub, wherein each of the blades has a front surface facing toward the air inlet and a rear surface facing toward the air outlet, and a surface roughness of the front surface is different from a surface roughness of the rear surface, wherein the front surface is made smooth relative to the rear surface and the rear surface has at least one rough area, such that the surface roughness of the rear surface is greater than the surface roughness of the front surface to increase an air outlet pressure of the axial-flow heat dissipation fan, wherein the rough area is made by molding, and a mold surface of the molding has an etching pattern with the etching depth of the etching pattern being 10 μm to 45 μm, the density of the etching particles of the etching pattern being 15 to 150 per centimeter, and an etched microstructure of the rough area is a corresponding pattern of the mold surface.

2. The axial-flow heat dissipation fan according to claim 1, wherein the rough area extends from the hub to an end edge of the rear surface, which is the farthest point of the rear surface relative to the hub.

3. The axial-flow heat dissipation fan according to claim 2, wherein each of the blades further has a leading edge and a trailing edge respectively adjoining the front surface and the rear surface, and the rough area of the rear surface extends from the hub to the end edge along the trailing edge.

4. The axial-flow heat dissipation fan according to claim 3, when the blades are rotated with the hub, the leading edge is located on a windward side and the trailing edge is located on a leeward side.

5. The axial-flow heat dissipation fan according to claim 3, wherein the rear surface of each of the blades has a plurality of rough areas, a roughness of the rough area adjacent to the trailing edge is greater than or equal to a roughness of the rough area far from the trailing edge.

* * * * *